US010351316B2

(12) United States Patent
Jones

(10) Patent No.: US 10,351,316 B2
(45) Date of Patent: Jul. 16, 2019

(54) WATER BOTTLE WITH SELF-CLOSING VALVE

(71) Applicant: Specialized Bicycle Components, Inc., Morgan Hill, CA (US)

(72) Inventor: Ryan Curt Jones, Morgan Hill, CA (US)

(73) Assignee: SPECIALIZED BICYCLE COMPONENTS, INC., Morgan Hill, CA (US)

( * ) Notice: Subject to any disclaimer, the term of this patent is extended or adjusted under 35 U.S.C. 154(b) by 0 days.

(21) Appl. No.: 15/115,565

(22) PCT Filed: Jan. 29, 2015

(86) PCT No.: PCT/US2015/013507
§ 371 (c)(1),
(2) Date: Jul. 29, 2016

(87) PCT Pub. No.: WO2015/116809
PCT Pub. Date: Aug. 6, 2015

(65) Prior Publication Data

US 2017/0166364 A1 Jun. 15, 2017

Related U.S. Application Data

(60) Provisional application No. 61/934,278, filed on Jan. 31, 2014.

(51) Int. Cl.
*B65D 83/44* (2006.01)
*B65D 47/20* (2006.01)
(Continued)

(52) U.S. Cl.
CPC ..... *B65D 47/2031* (2013.01); *B65D 5/42* (2013.01); *B67D 3/00* (2013.01); *B65D 47/04* (2013.01)

(58) Field of Classification Search
CPC ..... B65D 47/2031; B65D 5/42; B65D 3/00; B65D 47/04; B65D 51/1644; B65D 51/165
(Continued)

(56) References Cited

U.S. PATENT DOCUMENTS 3,294,294 A 12/1966 Amburgey
3,521,796 A 7/1970 Roy
(Continued)

FOREIGN PATENT DOCUMENTS

CA 2227888 2/1997
CN 1207084 2/1999
(Continued)

OTHER PUBLICATIONS

EP15743334.3 Supplementary European Search Report dated Sep. 7, 2017 (16 pages).
(Continued)

*Primary Examiner* — J. Gregory Pickett
*Assistant Examiner* — Niki M Eloshway
(74) *Attorney, Agent, or Firm* — Michael Best & Friedrich LLP

(57) ABSTRACT

A liquid-dispensing container comprises a housing and a valve member. The housing is adapted to hold a liquid and includes an opening defined by a wall having an inner edge and an outer edge. The valve member has a ledge engaging the outer edge and a cleat engaging the inner edge. The valve member can further include an integral gasket positioned between the ledge and the cleat and deformed in engagement with the wall. The cleat preferably includes a beveled surface. The valve member can be inserted from the outside of the housing and without the need for additional retention members. Specifically, the valve member is secured to the housing by contacting the cleat with the outer edge of the
(Continued)

wall, moving the valve member toward the housing such that the cleat passes through the opening, and engaging the cleat with the inner edge of the wall.

20 Claims, 5 Drawing Sheets

(51) Int. Cl.
*B65D 5/42* (2006.01)
*B67D 3/00* (2006.01)
*A47G 19/22* (2006.01)
*B65D 47/04* (2006.01)

(58) Field of Classification Search
USPC ..... 220/714, 717; 215/311
See application file for complete search history.

(56) References Cited

U.S. PATENT DOCUMENTS 3,738,545 A 6/1973 Roy
4,133,446 A 1/1979 Albert
4,408,702 A 10/1983 Horvath
4,961,888 A 10/1990 Brown
4,991,745 A 2/1991 Brown
5,033,655 A 7/1991 Brown
5,193,264 A 3/1993 Brown
5,213,236 A 5/1993 Brown et al.
5,339,995 A 8/1994 Brown et al.
5,377,877 A 1/1995 Brown et al.
5,390,805 A 2/1995 Bilani et al.
5,409,144 A 4/1995 Brown
5,439,143 A 8/1995 Brown et al.
5,676,289 A 10/1997 Gross et al.
5,839,614 A 11/1998 Brown
5,839,626 A 11/1998 Gross et al.
5,890,621 A * 4/1999 Bachman ..... A47G 19/2272 215/11.4
5,897,033 A 4/1999 Okawa et al.
5,971,232 A 10/1999 Rohr et al.
6,045,004 A 4/2000 Elliott
6,062,435 A 5/2000 Hess, III
6,079,594 A 6/2000 Brown et al.
6,176,474 B1 1/2001 Stanek et al.
6,213,355 B1 4/2001 Schwanenberg
6,257,453 B1 7/2001 Graham
6,273,296 B1 8/2001 Brown
6,279,783 B1 8/2001 Brown et al.
6,305,570 B1 10/2001 Atkin et al.
H2027 H 6/2002 Brown et al.
6,427,874 B2 8/2002 Brown et al.
6,450,375 B1 9/2002 Hins et al.
6,523,711 B1 2/2003 Hughes et al.
6,749,092 B2 6/2004 Olechowski et al.
6,769,577 B1 8/2004 Feierabend
6,827,241 B2 12/2004 Bouzaglo
6,910,607 B2 6/2005 Gaiser et al.
6,951,295 B1 10/2005 Gaus et al.
7,077,296 B2 7/2006 Brown et al.
7,077,742 B2 7/2006 Stevenson et al.
7,086,572 B2 8/2006 Socier et al.
7,117,654 B2 10/2006 Danks
7,152,763 B2 12/2006 Stull et al.
RE39,520 E 3/2007 Hess, III et al.
7,661,560 B2 * 2/2010 Murray ..... B65D 47/147 215/311
7,784,652 B2 8/2010 Gaus et al.
8,016,507 B2 9/2011 Wright
8,079,385 B2 12/2011 Hatton
8,557,359 B2 10/2013 Yang et al.
2001/0025862 A1 10/2001 Brown et al.
2002/0179616 A1 12/2002 Elder
2003/0222238 A1 * 12/2003 Getzewich ..... B65D 47/2018 251/342
2005/0211735 A1 9/2005 Socier et al.
2005/0257837 A1 11/2005 Bailey
2006/0037975 A1 2/2006 Suffa
2006/0138179 A1 6/2006 Suffa
2007/0029334 A1 2/2007 Bagley
2007/0062906 A1 * 3/2007 Morano ..... B65D 47/06 215/311
2008/0110933 A1 5/2008 Goncalves
2008/0179340 A1 7/2008 Scott
2008/0230569 A1 9/2008 McConville et al.
2008/0237271 A1 10/2008 Olechowski
2008/0237278 A1 10/2008 Gaus et al.
2008/0264979 A1 10/2008 Nijland et al.
2008/0310770 A1 12/2008 Turvey et al.
2009/0212061 A1 * 8/2009 Naesje ..... A47G 19/2272 220/714
2009/0212078 A1 8/2009 Gaus
2010/0012686 A1 1/2010 Joehnk et al.
2010/0116371 A1 5/2010 Gaus
2010/0180971 A1 7/2010 Hatton
2011/0155750 A1 * 6/2011 Bernstein ..... A45F 3/16 220/714
2012/0248056 A1 10/2012 Fischer et al.
2012/0273521 A1 11/2012 Wu
2016/0137363 A1 * 5/2016 Wieder ..... A47G 19/2266 215/229

FOREIGN PATENT DOCUMENTS

CN 1666933 9/2005
DE 887771 8/1953
DE 29513995 11/1995
DE 19953706 1/2001
EP 0330785 9/1989
GB 2424871 10/2006

OTHER PUBLICATIONS

First Office Action from the State Intellectual Property Office of China for Application No. 201580012119.3 dated Oct. 25, 2017 (14 pages).
Second Office Action from the State Intellectual Property Office of China for Application No. 201580012119.3 dated Mar. 28, 2018 (14 pages).
Modulus of Elasticity—Young Moduluds for some common Materials'—The engineering Toolbox (2013) http://www.engineeringtoolbox.com/young-modulus-d_417.html (1 page).
EP15743334.3 Extended European Search Report dated Jan. 3, 2018 (15 pages).
Search Report from the Taiwan Intellectual Property Office for Application No. 104103300 dated Jan. 24, 2018 (13 Pages).
Third Office Action from the State Intellectual Property Office of China for Application No. 201310757022.8 dated Nov. 23, 2017 (18 pages).
European Patent Office Extended Search Report for Application No. 18184184.2 dated Oct. 11, 2018 (13 pages).

* cited by examiner

WATER BOTTLE WITH SELF-CLOSING VALVE

CROSS-REFERENCE TO RELATED APPLICATIONS

This is a U.S. national stage entry of International Patent Application No. PCT/US2015/013507, filed on Jan. 29, 2015, which claims priority to United States Provisional Patent Application No. 61/934,278, filed on Jan. 31, 2014, the entire contents of all of which are fully incorporated herein by reference.

BACKGROUND

The present invention relates generally to water bottles commonly used by athletes for hydration, and more specifically to such water bottles having self-closing valves.

Water bottles are commonly used by athletes and others to hold and dispense liquids, such as water and sports drinks. Water bottles commonly include a body, a cap, and a valve that is movable relative to the cap between open and closed positions. In the open position, liquid can be dispensed from the bottle, and in the closed position, liquid is inhibited from being dispensed from the bottle.

Water bottles valves are frequently in the form of poppet valves including a poppet that can be slid between open and closed positions. Such poppets usually include an engagement portion that facilitates engagement by the user to facilitate opening the valve. In addition to providing a valve function resulting from sliding the poppet between the open and closed positions, some poppets include an additional valve that inhibits the leakage of liquid when the poppet is open. For example, the poppet can include a flexible, self-closing valve, such as the valve disclosed in U.S. Pat. No. 7,784,652, which is hereby incorporated by reference in its entirety. These self-closing valves are commonly secured over an opening in a cap to inhibit flow of liquid from the water bottle. Sometimes these self-closing valves are secured to a non-movable opening (i.e., water bottles without a sliding poppet).

SUMMARY

The present invention provides a liquid-dispensing container comprising a housing (e.g., a bottle and a cap threaded together) and a valve member. The housing is adapted to hold a liquid in an interior volume and includes an opening defined by a wall having an inner edge and an outer edge. The valve member has a ledge engaging the outer edge of the side wall and a cleat spaced from the ledge and engaging the inner edge of the side wall. The valve member can further include an integral gasket positioned between the ledge and the cleat and deformed in engagement with the wall. In one embodiment, the cleat comprises a plurality of cleats circumferentially spaced from each other. Preferably, the cleat includes a beveled surface that facilitates insertion of the valve member into the housing.

By virtue of this arrangement, the valve member can be inserted from the outside of the housing and without the need for additional retention members. Specifically, the valve member is secured to the housing by engaging the cleat with the outer edge of the wall, moving the valve member toward the housing such that the cleat passes through the opening, and engaging the cleat with the inner edge of the wall. In the event that the valve member includes an integral gasket, the method includes the step of deforming the cleat against the wall. Preferably, the moving step includes deflecting the cleat away from the wall. In the event that the cleat includes a beveled surface, the engaging step includes engaging the beveled surface with the outer edge of the side wall.

Other aspects of the invention will become apparent by consideration of the detailed description and accompanying drawings.

Figure 1:
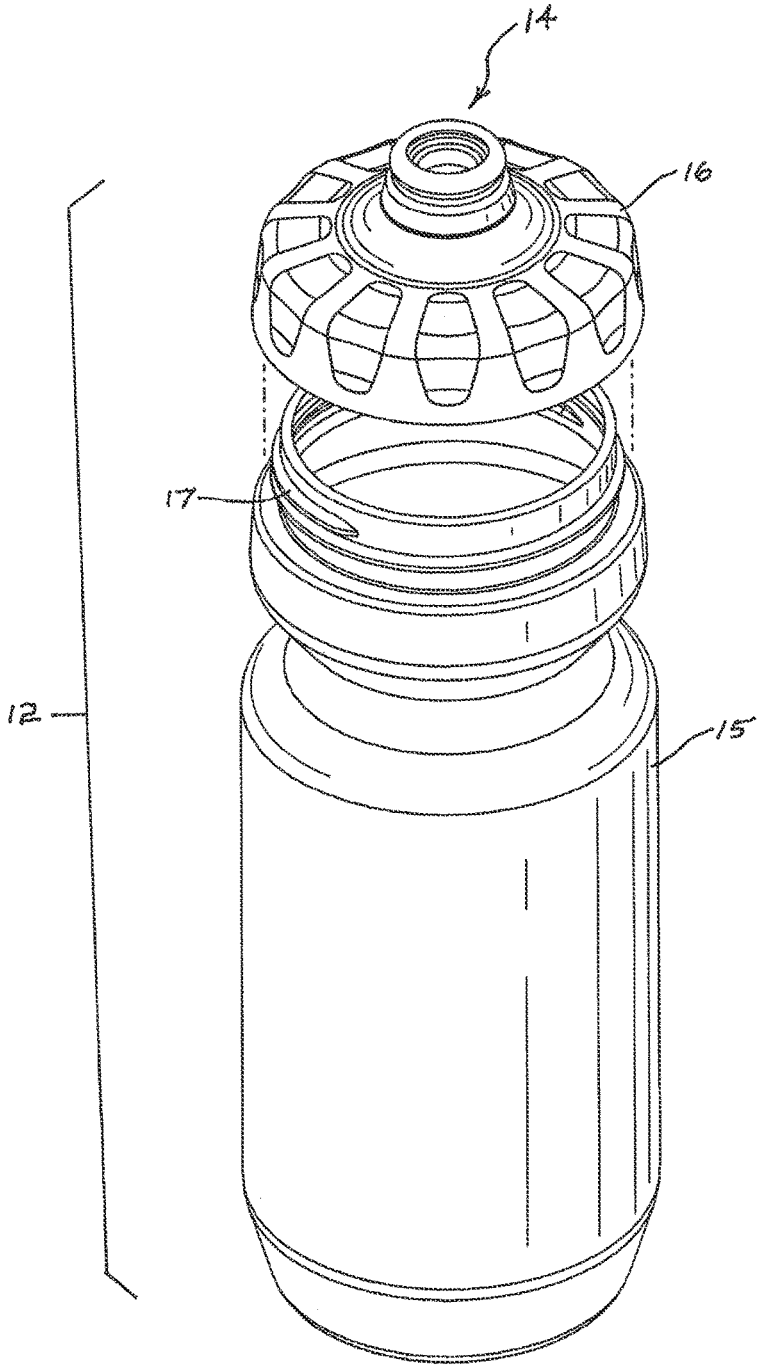
FIG. 1 is a perspective exploded view of a water bottle assembly embodying the present invention, including a bottle, a cap, and a valve member.
Figure 2:
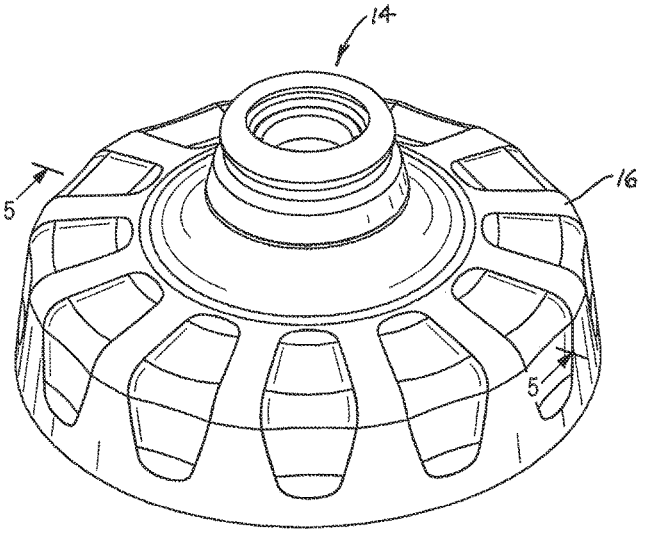
FIG. 2 is a top perspective view of the cap and valve member from FIG. 1.
Figure 3:
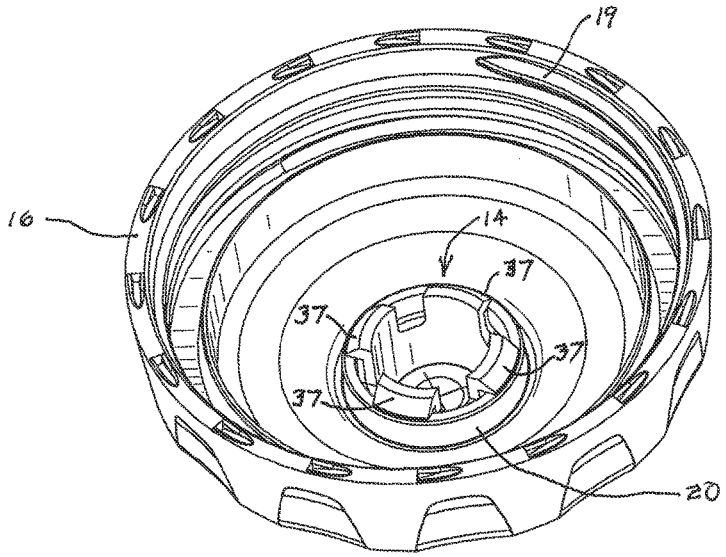
FIG. 3 is a bottom perspective view of the cap and valve member from FIG. 1.
Figure 4:
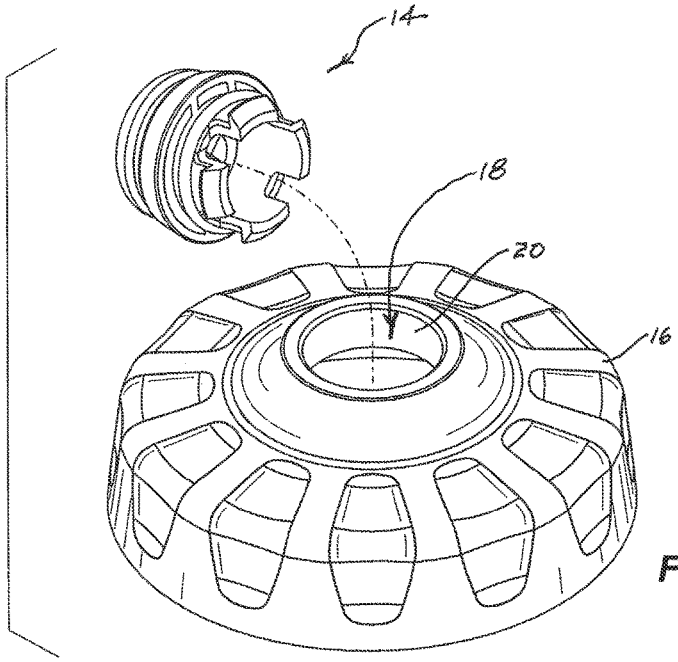
FIG. 4 is an exploded perspective view of the cap and valve member from FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

FIGS. 1-4 illustrate a liquid-dispensing container including a housing 12 and a valve member 14. The illustrated housing 12 is formed from a bottle 15 having outer threads 17 and a cap 16 having inner threads 19 threaded onto the bottle 15. Similar constructions are well known in the field of water bottles. The cap 16 includes a central opening 18 defined by a side wall 20 that receives the valve member 14.

Figure 5:
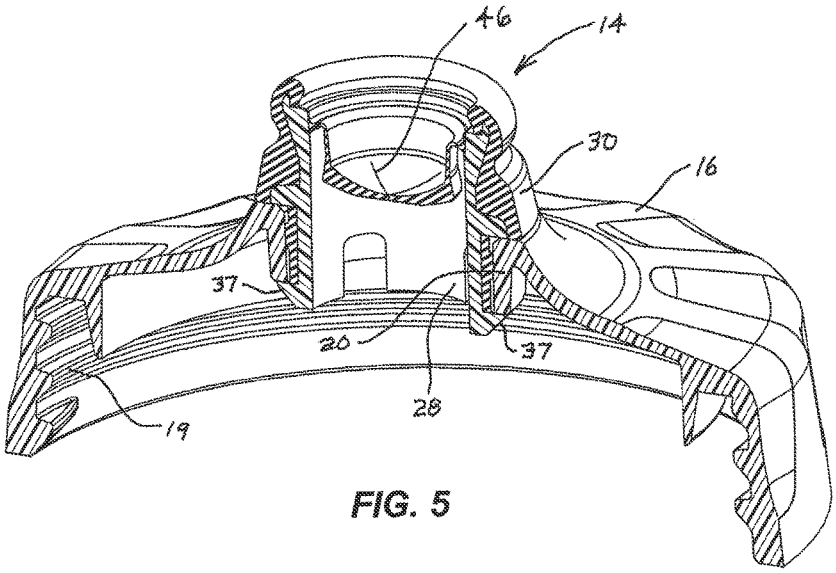
FIG. 5 is a section view taken along line 5-5 in FIG. 2.
Figure 6:
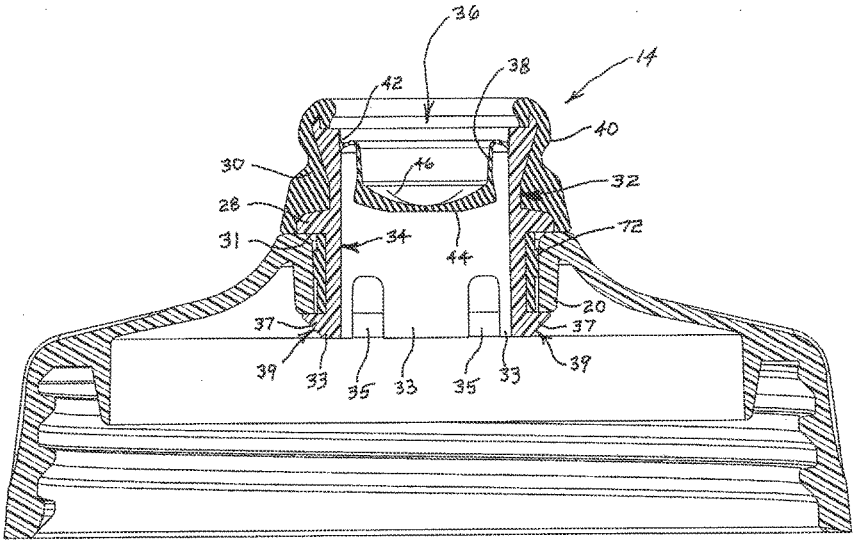
FIG. 6 is an enlarged section view taken along line 5-5 in FIG. 2.
Figure 7:
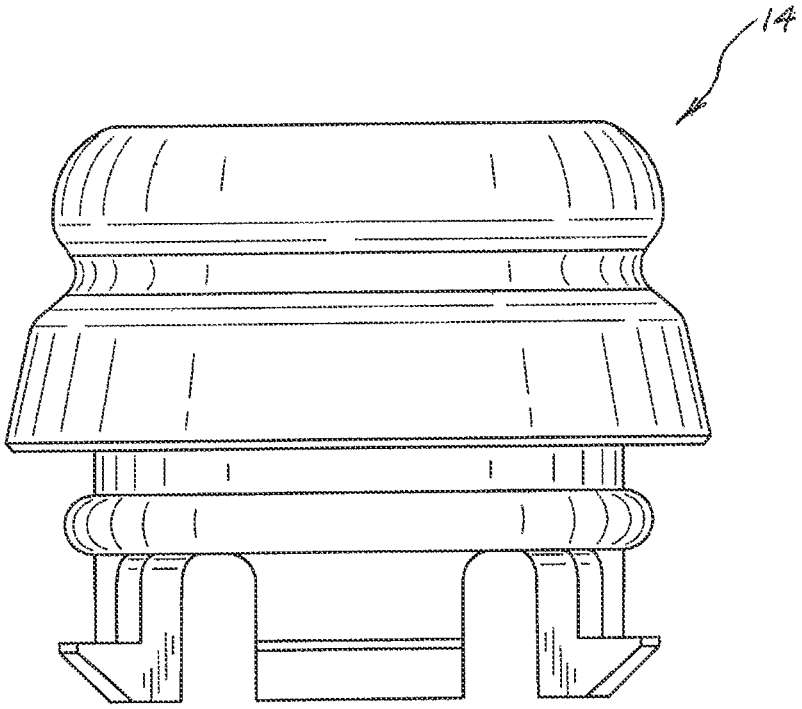
FIG. 7 is a side view of the valve member from FIG. 4.
Figure 8:
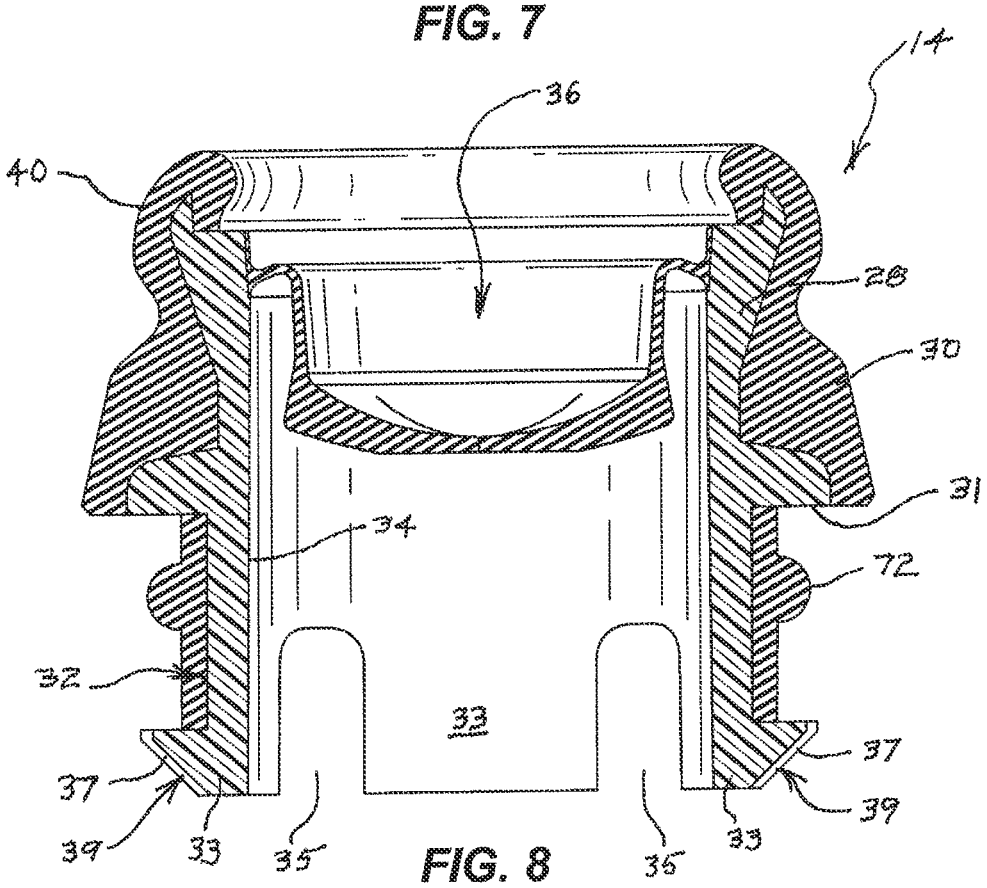
FIG. 8 is a section view of the valve member in FIG. 7.

As shown in FIGS. 5, 6, and 8, the valve member 14 includes an inner support 28 and an outer cover 30 co-molded over the inner support 28. The inner support 28 is a tubular structure made from a relatively stiff plastic material having a tensile modulus of elasticity of about 1,450,000 psi. The inner support 28 includes an exterior surface 32 and an interior surface 34 that defines an interior passage 36 that extends all the way through the valve member 14. The inner support 28 has a length that extends almost the entire length of the valve member 14. The exterior surface 32 of the support 28 defines an inner ledge 31. The lower end of the inner support 28 includes four flexible legs 33 separated by recesses 35. The end of each leg 33 includes a cleat 37 that will engage the inner edge of the side wall 20 when the valve member 14 is inserted into the central opening 18. In this position, shown in FIGS. 5-6, the inner ledge 31 engages the outer edge of the side wall 20, thereby securing the valve member 14 in the central opening 18. Each cleat 37 includes a beveled surface 39 that facilitates insertion of the valve member 14 into the central opening 18, as described below in more detail.

The outer cover 30 is co-molded with the inner support 28 using a material having a lower hardness and increased elasticity compared to the inner support 28. In the illustrated embodiment, the outer cover 30 is made from in elastomeric material having a durometer of about Shore A 50 and a tensile modulus of elasticity of about 800 psi. Co-molding the lower density outer cover 30 to the higher density inner support 28 decreases the number of parts required to seal the liquid-dispensing container against leaks, thereby increasing the durability of the valve member 14 of the illustrated embodiment in comparison with prior art valve members. The outer cover 30 includes an inner section 38 and an outer section 40 integrally formed with the inner section 38. The inner section 38 is engaged with and covers a relatively small part of the interior surface 34 of the upper end of the inner support 28. The inner section 38 includes an annular portion 42 that is engaged with and is secured to (e.g., co-molded with) the interior surface 34 of the inner support 28. The inner section 38 further includes a self-closing valve 44 supported by the annular portion 42 and substantially blocking the interior passage 36 through the inner support 28. The self-closing valve 44 includes slits 46 that defined four flaps that will open when sufficient pressure is applied to the valve 44. Self-closing valves of the type illustrated in the figures are well known in the field of water bottles.

The outer section 40 includes an integral gasket 72 positioned between the inner ledge 31 and the cleats 37. The gasket 72 is dimensioned to contact and be compressed against the side wall 20 of the cap 16 in order to provide a watertight seal between the valve member 14 and the cap 16.

In order to assemble the valve member 14 to the cap 16, the valve member 14 is aligned with the central opening 18 of the cap 16 and then the beveled surfaces 39 of the cleats 37 are brought into contact with the outer edge of the side wall 20 of the cap 16. Further movement of the valve member 14 toward the cap 16 results in the cleats 37 flexing slightly inward and/or the sidewall 20 flexing slightly outward to facilitate insertion of the valve member 14 into the central opening 18 of the cap 16. Eventually, the cleats 37 will pass and mechanically lock onto the inner edge of the side wall 20. In this position, the gasket 72 is deformed against the side wall 20 and the valve member 14 is secured in the central opening 18.

Various features and advantages of the invention are set forth in the following claims.

What is claimed is:

1. A liquid-dispensing container comprising:

a housing adapted to hold a liquid in an interior volume, the housing including an opening defined by an inner edge and an outer edge; and a valve member defined by a first material and a second material, the valve member having a ledge engaging the outer edge and a cleat spaced from the ledge and engaging the inner edge such that the valve member is fixed to the housing;

wherein the first material is harder than the second material;

wherein the cleat is defined by the first material;

wherein the valve member includes an inner support, with an interior passage extending through the inner support, and an outer cover co-molded with the inner support;

wherein the outer cover includes an inner section and an outer section, wherein the outer cover wraps around the inner support such that the inner section contacts an inwardly-facing interior surface of the inner support, and wherein the outer section contacts an opposite, outwardly-facing exterior surface of the inner support;

wherein the inner section includes a self-closing valve disposed within the interior passage and configured to selectively block the interior passage;

wherein the inner support is made of the first material; and wherein the outer cover is made of the second material.

2. A liquid-dispensing container as claimed in claim 1, wherein the housing includes a bottle and a separable cap.

3. A liquid-dispensing container as claimed in claim 2, wherein the separable cap includes the opening.

4. A liquid-dispensing container as claimed in claim 2, wherein the separable cap receives the valve member.

5. A liquid-dispensing container as claimed in claim 1, wherein the inner edge and the outer edge are defined by a wall and the valve member further includes an integral gasket positioned between the ledge and the cleat, the integral gasket being deformed in engagement with the wall.

6. A liquid-dispensing container as claimed in claim 1, wherein the valve member comprises multiple cleats circumferentially spaced from each other, the multiple cleats comprising the cleat.

7. A liquid-dispensing container as claimed in claim 1, wherein the cleat includes a beveled surface that facilitates insertion of the valve member into the housing.

8. A liquid-dispensing container as claimed in claim 7, wherein the cleat is secured to a flexible leg to facilitate biased movement of the cleat away from the inner edge.

9. A liquid-dispensing container as claimed in claim 1, wherein the cleat is secured to a flexible leg to facilitate biased movement of the cleat away from the inner edge.

10. A liquid-dispensing container as claimed in claim 1, wherein the ledge is at least partially defined by the first material.

11. A liquid-dispensing container as claimed in claim 1, wherein the inner section of the outer cover is integral with the outer section of the outer cover.

12. A liquid-dispensing container as claimed in claim 11, wherein the outer section of the outer cover covers at least a majority of the exterior surface.

13. A liquid-dispensing container as claimed in claim 12, wherein the inner section of the outer cover comprises an annular portion.

14. A liquid-dispensing container as claimed in claim 1, wherein the inner section of the outer cover comprises an annular portion.

15. A liquid-dispensing container as claimed in claim 1, wherein the second material is more elastic than the first material.

16. A liquid-dispensing container as claimed in claim 15, wherein the second material is less dense than the first material.

17. A liquid-dispensing container as claimed in claim 1, wherein the second material is less dense than the first material.

18. A liquid-dispensing container as claimed in claim 1, wherein the inner support comprises a tubular structure.

19. A liquid-dispensing container as claimed in claim 1, wherein the valve member comprises a length, and the inner support comprises a length less than the length of the valve member.

20. A liquid-dispensing container as claimed in claim 1, wherein a portion of the inner support is positioned between the inner section of the outer cover and the outer section of the outer cover.

* * * * *